US010214855B2

(12) United States Patent
Kajanto et al.

(10) Patent No.: US 10,214,855 B2
(45) Date of Patent: Feb. 26, 2019

(54) METHOD FOR MAKING MODIFIED CELLULOSE PRODUCTS

(71) Applicant: UPM-Kymmene Corporation, Helsinki (FI)

(72) Inventors: Isko Kajanto, Espoo (FI); Juha Tamper, Levanen (FI); Markus Nuopponen, Helsinki (FI); Tarja Sinkko, Lappeenranta (FI); Taisto Tienvieri, Vantaa (FI)

(73) Assignee: UPM-KYMMENE CORPORATION, Helsinki (FI)

( * ) Notice: Subject to any disclaimer, the term of this patent is extended or adjusted under 35 U.S.C. 154(b) by 0 days.

(21) Appl. No.: 15/035,496

(22) PCT Filed: Dec. 4, 2014

(86) PCT No.: PCT/FI2014/050955
§ 371 (c)(1),
(2) Date: May 10, 2016

(87) PCT Pub. No.: WO2015/082774
PCT Pub. Date: Jun. 11, 2015

(65) Prior Publication Data

US 2016/0289894 A1 Oct. 6, 2016

(30) Foreign Application Priority Data

Dec. 5, 2013 (FI) ..... 20136235

(51) Int. Cl.

| | |
|---|---|
| ***D21H 11/16*** | (2006.01) |
| ***D21C 9/00*** | (2006.01) |
| ***D21C 5/00*** | (2006.01) |
| ***D21H 11/18*** | (2006.01) |

(52) U.S. Cl.
CPC ..... *D21C 9/002* (2013.01); *D21C 5/005* (2013.01); *D21C 9/001* (2013.01); *D21C 9/007* (2013.01); *D21H 11/16* (2013.01); *D21H 11/18* (2013.01)

(58) Field of Classification Search
CPC ..... C08B 11/12; C08B 1/06; D21H 11/16; D21H 11/18; D21C 9/002; D21C 9/001; D21C 9/007
See application file for complete search history.

(56) References Cited

U.S. PATENT DOCUMENTS

| | | | | |
|---|---|---|---|---|
| 4,481,077 | A | 11/1984 | Herrick | |
| 2004/0004804 | A1 | 1/2004 | Levi | |
| 2012/0135506 | A1 | 5/2012 | Heiskanen et al. | |
| 2014/0323714 | A1* | 10/2014 | Sivonen | C08B 1/06 536/69 |

FOREIGN PATENT DOCUMENTS

| | | | | |
|---|---|---|---|---|
| CA | 2856151 | A1 | 5/2013 | |
| CN | 2384701 | Y | 6/2000 | |
| JP | 2006028721 | | 2/2006 | |
| JP | 2013104133 | | 5/2013 | |
| WO | 0129309 | A1 | 4/2001 | |
| WO | 2011004300 | | 1/2011 | |
| WO | 2011141877 | | 11/2011 | |
| WO | 2012107642 | A1 | 8/2012 | |
| WO | WO 2013/076376 | * | 5/2013 | C08B 11/12 |
| WO | 2013121086 | | 8/2013 | |
| WO | 2013121104 | A9 | 8/2013 | |
| WO | 2013183007 | A1 | 12/2013 | |
| WO | 2014029909 | A1 | 2/2014 | |
| WO | 2014087052 | A1 | 6/2014 | |
| WO | 2014140275 | | 9/2014 | |
| WO | 2014174152 | A1 | 10/2014 | |
| WO | 2014184438 | A1 | 11/2014 | |

OTHER PUBLICATIONS

Henriksson, et al., "An Environmentally Friendly Method for Enzyme-Assisted Preparation of Microfibrillated Cellulose (MFC) Nanofibers" European Polymer Journal vol. 43 (2007), pp. 3434-3441.
International Search Report dated Apr. 23, 2015; International Application No. PCT/FI2014/050955; International Filing Date Dec. 4, 2014 (4 pages).
Written Opinion dated Dec. 4, 2014, International Application No. PCT/FI2014/050955; International Filing Date Dec. 4, 2014 (7 pages).

* cited by examiner

*Primary Examiner* — Mark Halpern
(74) *Attorney, Agent, or Firm* — Cantor Colburn LLP

(57) ABSTRACT

Method for making modified cellulose products comprises —processing cellulose pulp to modified cellulose pulp at a manufacturing location to increase the susceptibility of fibers to disintegration, —setting the modified cellulose pulp to a suitable dry matter content, and —transporting the modified cellulose pulp at set dry matter content to a location of use, where the modified cellulose pulp is disintegrated to nanofibrillar cellulose.

19 Claims, 7 Drawing Sheets

METHOD FOR MAKING MODIFIED CELLULOSE PRODUCTS

CROSS-REFERENCE TO RELATED APPLICATIONS

This application is a 371 of PCT/FI2014/050955 filed 4 Dec. 2014, which claims the benefit of Finnish Application No. 20136235, filed Dec. 5, 2013, both of which are incorporated by reference herein in their entirety.

FIELD OF THE INVENTION

The invention relates to a method for making modified cellulose products. The invention also relates to an apparatus for making nanofibrillar cellulose and a modified cellulose product.

BACKGROUND OF THE INVENTION

Cellulose is a renewable natural polymer that can be converted to many chemical derivatives. The derivatization takes place mostly by chemical reactions of the hydroxyl groups in the β-D-glucopyranose units of the polymer. By chemical derivatization the properties of the cellulose can be altered in comparison to the original chemical form while retaining the polymeric structure.

If cellulose in fibers is derivatized in a suitable way, the fibers are easier to disintegrate to the level of fibrils, nanofibrillar cellulose, because of weakened bonds between the fibrils. For this purpose the cellulose can be anionized or cationized. For example catalytic oxidation of cellulose by heterocyclic nitroxyl compounds (such as "TEMPO", i.e. 2,2,6,6-tetramethylpiperidinyl-1-oxy free radical) produces anionic cellulose where part of C-6 hydroxyl groups are oxidized to aldehydes and carboxylic acids. Another method to produce anionic cellulose is carboxymethylation of cellulose molecules. Cationic cellulose can be produced by adding quaternary ammonium groups to cellulose molecules.

In practice, pulp which contains cellulosic fibers in suspension is subjected to chemical modification to reach a suitable degree of substitution, whereafter the fibers are disintegrated to fibrils with nanofibrillar cellulose as product.

Nanofibrillar cellulose can be produced in a variety of ways, but the common feature is that the modified pulp is processed at a relatively low consistency. Consequently, the resulting nanofibrillar cellulose is a liquid dispersion with a correspondingly low concentration. The concentration of the nanofibrillar cellulose in the dispersion is usually below 5 wt-%, usually about 1 to 4 wt-%.

One of the most prominent physical properties of the nanofibrillar cellulose is that it forms a highly viscous gel in concentrations above 1%. Raising the concentration of this type of gel to decrease transportation costs from the manufacturing location is desirable. Although methods have been developed for lowering the water content of the gel, it requires time and energy, and increase the price of the nanofibrillar cellulose. With some grades of nanofibrillar cellulose, excessive dewatering or drying can even alter the properties of the nanofibrillar cellulose so that it has no longer the same rheological characteristics when it is redispersed in water at the location of use.

SUMMARY OF THE INVENTION

It is the purpose to provide a method for making modified cellulose products which allows better management of the production and transport chain.

Cellulose in fibrous form, cellulose pulp, is first processed to modified cellulose pulp at the manufacturing location to increase the susceptibility of fibers to disintegration, and the modified cellulose in fibrous form is transported at a suitable dry matter content to the location of use, where the fibers are disintegrated to nanofibrillar cellulose ("on-site" fibrillation). The manufacturing location is the location where the cellulose pulp is modified, and it can be for example a chemical pulp mill which uses the chemical pulp produced by the mill as the raw material.

The modified cellulose in fibrous form exists as suspension or more or less dry mass after the cellulose has been processed to modified cellulose, depending on the modification method. As a result of the modification, the pulp contains residual substances, which must be removed from the modified cellulose pulp by washing. During the washing the modified cellulose pulp becomes an aqueous suspension, which is dewatered at the manufacturing location to dry matter content suitable for dispatch, whereafter the modified cellulose is transported in this dry matter content to the location of use.

In washing, the modified cellulose pulp is diluted with washing water, whereafter the washing water, together with the dissolved substances (such as salts) and possible other impurities carried by the water from the pulp, is removed mechanically from the pulp, for example by pressing. This can be repeated the required number of times so that the washed modified cellulose pulp has the content of residual substances below the required limit. The washing efficiency can also be expressed by conductivity, which is discussed later. After the washing, the modified cellulose pulp can be already at the dry matter content suitable for transport, or its dry mater content can be increased further, for example by air drying, where water is removed by evaporation.

Drying the modified cellulose in fibrous form does not affect the properties of the cellulose when it is dried to a suitable range, which is dependent on the modified cellulose grade. The degree of drying can also be dependent on the means of transport and the transport distance. After the transport, the fibres of the modified cellulose pulp can be dispersed to suitable consistency and processed to nanofibrillar cellulose at the site of use.

Conventional pulp drying methods can be used in the drying of the modified cellulose to the desired dry matter content for dispatch. Water can be removed mechanically by a belt filter press or a pressure filter. The modified cellulose pulp can be transported in the dry matter obtained by mechanical dewatering. The dry matter content where the modified pulp will be transported can ultimately be reached by evaporation.

Modification of cellulose to increase the susceptibility of fibers to disintegration can be chemical modification to make derivatized cellulose, such as anionization or cationization.

At the location of use, the modified cellulose is suspended to the consistency suitable for processing it to the nanofibrillar cellulose by means of a disintegrating device and other equipment at the location. The produced nanofibrillar cellulose can be further diluted from the production concentration to the concentration suitable for the end use.

DESCRIPTION OF THE DRAWINGS

The method will be described in the following with reference to the accompanying drawings, where.

DETAILED DESCRIPTION OF PREFERRED EMBODIMENTS

Modification of Cellulose Pulp

Figure 1:
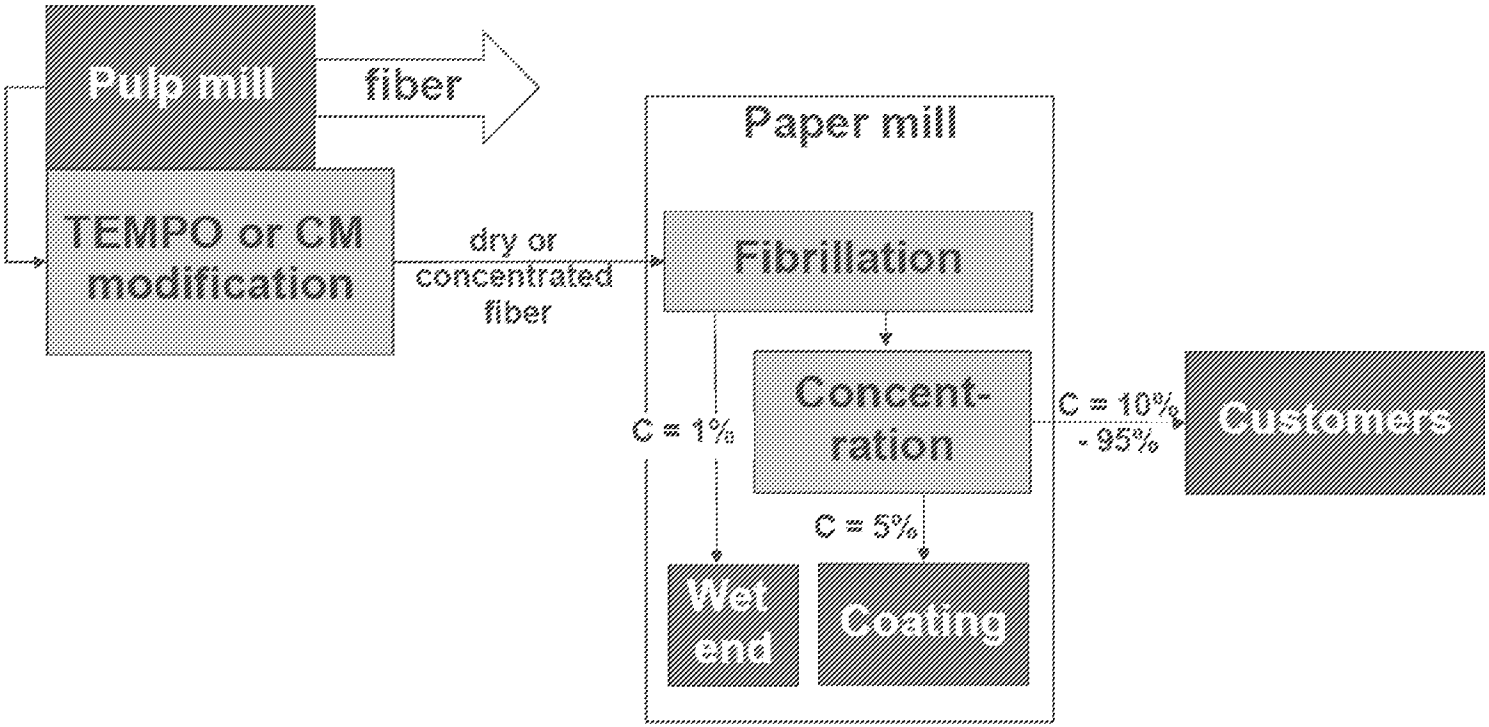
FIG. 1 illustrates the method according to one embodiment.

The fibrous raw material for modification of cellulose is obtained normally from cellulose raw material of plant origin. The raw material can be based on any plant material that contains cellulosic fibers, which in turn comprise microfibrils of cellulose. The fibers may also contain some hemicelluloses, the amount of which is dependent on the plant source. The plant material may be wood. Wood can be from softwood tree such as spruce, pine, fir, larch, douglas-fir or hemlock, or from hardwood tree such as birch, aspen, poplar, alder, eucalyptus or acacia, or from a mixture of softwoods and hardwoods. Non-wood material can be from agricultural residues, grasses or other plant substances such as straw, leaves, bark, seeds, hulls, flowers, vegetables or fruits from cotton, corn, wheat, oat, rye, barley, rice, flax, hemp, manila hemp, sisal hemp, jute, ramie, kenaf, bagasse, bamboo or reed.

One preferred alternative is fibers from non-parenchymal plant material where the fibrils of the fibers are in secondary cell walls. The fibrils originating in secondary cell walls are essentially crystalline with degree of crystallinity of at least 55%. The source can be wood or non-wood plant material. For example wood fibres are one abundant fibrous raw material source. The raw material can be for example chemical pulp. The pulp can be for example softwood pulp or hardwood pulp or a mixture of these.

The common characteristic of all wood-derived or non-wood derived fibrous raw materials is that nanofibrillar cellulose is obtainable from them by disintegrating the fibers to the level of microfibrils or microfibril bundles.

The modification is performed to fibrous raw material which exists as a suspension in a liquid, that is, pulp.

The modification treatment to the fibers can be chemical or physical. In chemical modification the chemical structure of cellulose molecule is changed by chemical reaction ("derivatization" of cellulose), preferably so that the length of the cellulose molecule is not affected but functional groups are added to β-D-glucopyranose units of the polymer. The chemical modification of cellulose takes place at a certain conversion degree, which is dependent on the dosage of reactants and the reaction conditions, and as a rule it is not complete so that the cellulose will stay in solid form as fibrils and does not dissolve in water. In physical modification anionic, cationic, or non-ionic substances or any combination of these are physically adsorbed on cellulose surface. The modification treatment can also be enzymatic.

The cellulose in the fibers can be especially ionically charged after the modification, because the ionic charge of the cellulose weakens the internal bonds of the fibers and will later facilitate the disintegration to nanofibrillar cellulose. The ionic charge can be achieved by chemical or physical modification of the cellulose. The fibers can have higher anionic or cationic charge after the modification compared with the starting raw material. Most commonly used chemical modification methods for making an anionic charge are oxidation, where hydroxyl groups are oxidized to aldehydes and carboxyl groups, and carboxymethylation. A cationic charge in turn can be created chemically by cationization by attaching a cationic group to the cellulose, such as quaternary ammonium group.

One preferred modification method is the oxidation of cellulose. In the oxidation of cellulose, the primary hydroxyl groups of cellulose are oxidized catalytically by a heterocyclic nitroxyl compound, for example 2,2,6,6-tetramethylpiperidinyl-1-oxy free radical, "TEMPO". These hydroxyl groups are oxidized to aldehydes and carboxyl groups. Thus, part of the hydroxyl groups that are subjected to oxidation can exist as aldehyde groups in the oxidized cellulose, or the oxidation to carboxyl groups can be complete.

The consistency of the pulp can vary according to the modification method. For example in the catalytic oxidation of cellulose, the consistency is normally 1-4 wt-%. However, in the modification, higher consistencies in the MC (medium consistency) range (up to 12 wt-%, preferably 8-12%, or even higher than 12%) can be used to reduce the amount of water needed. For example it has been found that cellulose can be oxidized catalytically at pulp initial consistency of 8-12% with good selectivity. The consistency values given above represent the starting consistency of the pulp. The consistency of the pulp may change during the modification process for example due to materials added in course of the process.

As a result of the modification, fibers in the pulp will contain cellulose that is more susceptible to fibrillation (disintegration to fibrils) than before the modification, that is, the product can be called "easily fibrillated pulp".

The pulp where the cellulose is chemically modified can be characterized by degree of substitution or content of chemical groups. For pulp modified by catalytic oxidation, the following values can be given:

- anionicity between 0.5-1.4 meq/g, preferably 0.7-1.1 meq/g (corresponding to carboxylate content of 500-1400 μmol/g, preferably 700-1100 μmol/g).
- low chloride content of the pulp <0.5 g/kg, preferably <0.15 g/kg, which is most conveniently measurable by measuring the conductivity.

All values are based on the amount of dried pulp.

In the case of carboxymethylated cellulose, the degree of substitution can be in the range of 0.05-0.3, preferably 0.10-0.25. In the case of cationized cellulose, the degree of substitution can be 0.05-0.8, preferably 0.1-0.45.

Figure 3:
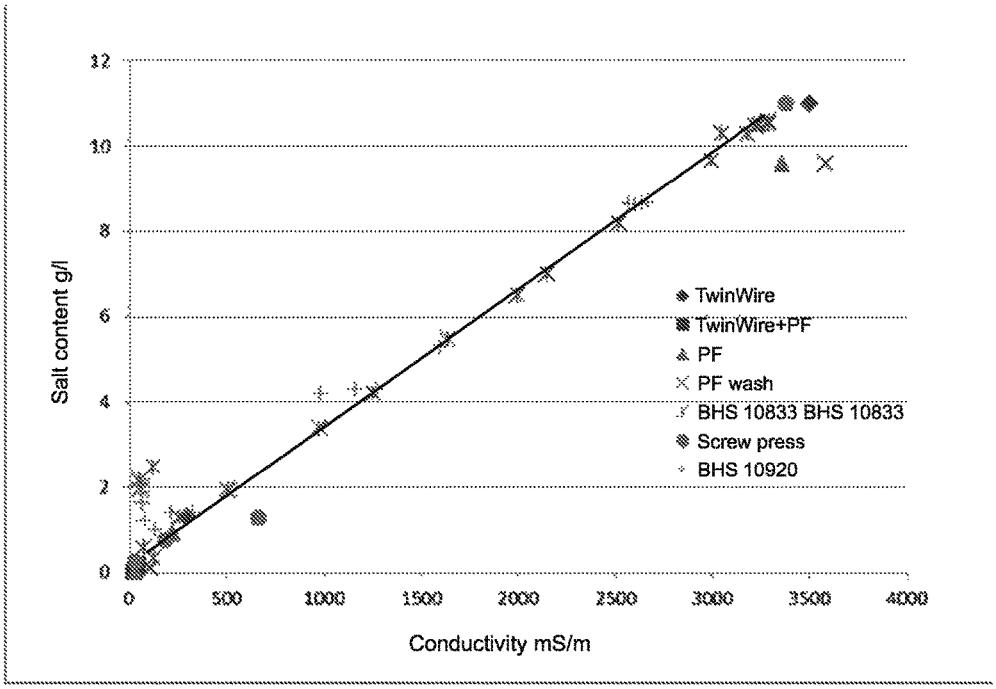
FIG. 3 shows the correlation between the salt concentration and the conductivity of the modified cellulose pulp.
Figure 4:
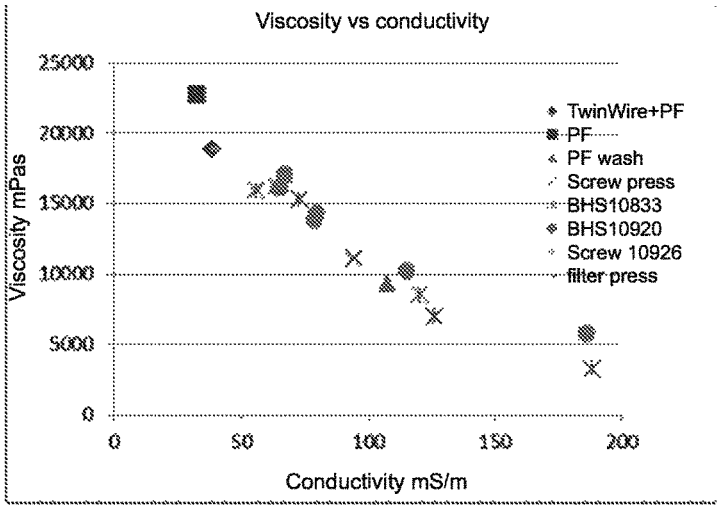
FIGS. 4 and 5 show the correlation between the conductivity of the modified cellulose pulp and the viscosity of the nanofibrillar cellulose obtained from the modified cellulose pulp.
Figure 5:
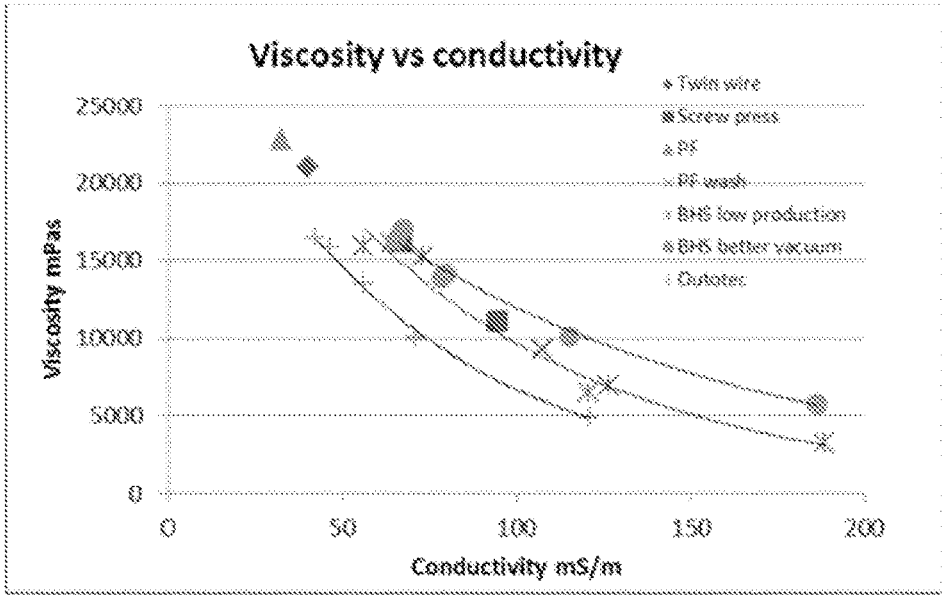

Conductivity measurement at 2.5% consistency of the modified pulp describes very well the washing efficiency or degree of washing of the pulp, which is illustrated by FIG. 3. In addition there is a clear correlation between conductivity and fibrillation efficiency, as is shown by FIGS. 4 and 5.

The dry matter content of "TEMPO" oxidized pulp after washing stages is typically between 20-25%. Pulp is diluted in pulper to 2.5% consistency by using tap water before the fibrillation stage. Conductivity is typically measured at fibrillation consistency, in this case at 2.5%. Sample is mixed carefully before conductivity measurement. Measurement is done using HACH HQd laboratory meter and the result is given in unit mS/m. (S=Siemens).

Thus, it has been found that when the salt contained in the modified cellulose pulp after the catalytic oxidation (with heterocyclic nitroxyl compounds like "TEMPO" as catalyst)

is reduced, the fibers of the modified cellulose pulp can be more easily disintegrated to nanofibrillar cellulose. The quality of the modified cellulose used for making nanofibrillar cellulose can thus be characterized with the conductivity. The measured conductivity of the modified cellulose pulp, when suspended at a consistency of 2.5 wt-% in deionized water, is below 200 mS/m, preferably below 150 mS/m, and most preferably below 100 mS/m. The conductivity values as low as below 50 mS/m can even be attained by washing, if very high quality modified pulp is made. The conductivity values measured in the above mentioned way can be used also to characterize carboxymethylated cellulose, which also contains salt after the modification, but the conductivity can be used as a quality standard in general for all modified cellulose pulp grades, including cationized cellulose.

The conductivity is determined in deionized water at a fixed consistency so that the ions of water do not interfere with the result and the values give a certain standard exclusively for the modified cellulose pulp transported to the user. The conductivity of the suspension before the fibrillation will be dependent on the consistency of the cellulose pulp and on the water used at the location.

Transport of Modified Cellulose

After the modification, the fibers containing the modified cellulose are transported to another location from the manufacturing location. The pulp obtained after the modification is set to suitable dry matter content in connection with washing or after the washing to reduce the transportation costs. The dry matter content of the pulp is dependent of the pulp grade, and can be 5-95 wt-%, more preferably 10-95 wt-%, and most preferably 20-60 wt-% for transport. Prior to setting the final dry matter content of transporting, the pulp is washed in one or more steps to remove the chemical residues of the modification process and to reduce the conductivity, which has proved important. The setting of the final dry matter content of transporting thus comprises dewatering by removal of the washing water together with residual substances entrained by the washing water, such as dissolved salts. After washing, the dry matter content can be increased further by evaporation.

The dry matter content of 20-60 wt-% is suitable for transport, because the processing costs increase with the amount of water which is to be removed from the modified pulp, especially in higher dry matter contents. The range of 20-60 wt-% is especially suitable for modified cellulose pulp where the cellulose is catalytically oxidized.

In general, the cellulosic fibers of the modified cellulose pulp can be dewatered more easily than strongly hydrophilic nanofibrillar cellulose, irrespective of the modification method and the grade of the modified cellulose pulp.

The pulp is modified moderately and is not disintegrated mechanically before the transport. The SR number (Schopper-Riegler) of such pulp is typically below 20, which characterizes the easy dewaterability of the pulp and is a typical value for unbeaten pulp.

For the transport of the modified cellulose pulp, any means of transport conventionally used for pulp can be used. The modified cellulose pulp can be transported in closed rigid containers, especially in shipping containers, or in bags, especially so called big bags, also known as FIBC/flexible intermediate bulk container). If the dry matter content is 60 wt-% or more, the modified cellulose pulp can be transported in bales. The transport can take place by road vehicles, trains or ships, or even as air freight.

Nanofibrillar Cellulose Manufacture

The modified cellulose in fibrous form is transported to the location of use, where it is made to nanofibrillar cellulose.

Nanofibrillar cellulose (NFC) refers to a collection of isolated cellulose microfibrils or microfibril bundles derived from cellulose raw material. Nanofibrillar cellulose has typically a high aspect ratio: the length might exceed one micrometer while the number-average diameter is typically below 200 nm. The diameter of nanofibril bundles can also be larger but generally less than 5 μm. The smallest nanofibrils are similar to so called elementary fibrils, which are typically 2-12 nm in diameter. The dimensions of the fibrils or fibril bundles are dependent on raw material and disintegration method. The nanofibrillar cellulose may also contain some hemicelluloses; the amount is dependent on the plant source. Mechanical disintegration of nanofibrillar cellulose from the fibers of the modified cellulose (easily fibrillated pulp) is carried out with suitable equipment such as a refiner, grinder, homogenizer, colloider, friction grinder, ultrasound sonicator, fluidizer such as microfluidizer, macrofluidizer or fluidizer-type homogenizer. The disintegration method is to some extent dependent on the modification method and conversion degree of the cellulose.

At the location of use, the fibers of the modified cellulose are diluted to suitable consistency, which is dependent on the disintegration method. The starting concentration of the pulp in most cases is between 1-5%. The NFC issues from the disintegration at approximately the same concentration as the starting pulp. Thus, at the site of use, prior to the disintegration, the fibers of modified cellulose are preferably diluted to the same concentration as is desired for the NFC of the end application. However, it is possible that the concentration of NFC obtained from the disintegration is adjusted for the end use. It is for example possible that the fibers are disintegrated at higher consistency than the final use concentration of the NFC, and the NFC obtained from the disintegration is diluted to the final use concentration.

The energy demand of the easily fibrillated pulp (expressable as kWh/ton or corresponding variables) to reach the same target level of fibrillation is lower with modified pulp, compared with the unmodified pulp from the same batch and processed at the same consistency. In some cases the unmodified pulp cannot even be disintegrated to nanofibrillar cellulose. As mentioned before, the conductivity of the modified cellulose pulp influences the fibrillation result.

The nanofibrillar cellulose can also be characterized through some rheological values. NFC forms a viscous gel, "hydrogel" when dispersed in water already at relatively low concentrations (1-2 wt-%). A characteristic feature of the NFC is its shear thinning behaviour in aqueous dispersion, which is seen as a decrease in viscosity with increasing shear rate. Further, a "threshold" shear stress must be exceeded before the material starts to flow readily. This critical shear stress is often called the yield stress. The viscosity of the NFC can be best characterized by zero-shear viscosity, which corresponds to the "plateau" of constant viscosity at small shearing stresses approaching zero.

The zero-shear viscosity of the NFC measured with a stress controlled rotational rheometer at a concentration of 0.5% (aqueous medium) can vary within wide boundaries, depending on the modification method and conversion degree, and it is typically between 1000 and 100000 Pa·s, preferably 5000 and 50000 Pa·s. The yield stress of the NFC determined by the same method is between 1 and 50 Pa, preferably in the range of 3-15 Pa.

Practical Examples

FIG. 1 illustrates the method together with alternative uses of the NFC. The manufacturing location is a pulp mill that produces for example chemical pulp for cellulosic raw material. The chemical pulp, which is manufactured with known chemical pulping methods, is dispatched to various destinations (arrow "fiber"). The chemical pulp is also modified at the pulp mill to make easily fibrillated pulp, where fibers contain modified cellulose (process "TEMPO or CM modification"). Although catalytic oxidation (TEMPO) and carboxymethylation (CM) are examples of the modification, any chemical, physical or enzymatic modification method can be used which produces easily fibrillated pulp.

The pulp is dried or concentrated to desired dry matter content prior it is dispatched to the destination, location of use. The arrow "dry or concentrated fiber" represents the transport of this dried or concentrated easily fibrillated pulp. The transport can take place by road, railroad or sea or by combination of these modes of transport. The location of use in this case is a paper mill where the easily fibrillated pulp is disintegrated to NFC by "on-site" fibrillation (process "Fibrillation"). At the paper mill the NFC can be processed further depending on the end use at the paper mill. For wet end addition to the furnish for making paper, the NFC can stay at the original concentration obtained from the disintegration (in this example 1 wt-%) and for adding the NFC to paper coating composition, it can be concentrated from the original concentration (in this example to 5 wt-%).

In addition to using the on-site manufactured NFC at the location of use, the paper mill, it can be dispatched from there further to customers, for example in a concentrated state (10-95 wt-%). These other customers may use the NFC to other purposes than for paper manufacture, and/or they can be paper mills using the NFC for paper manufacture.

Figure 2:
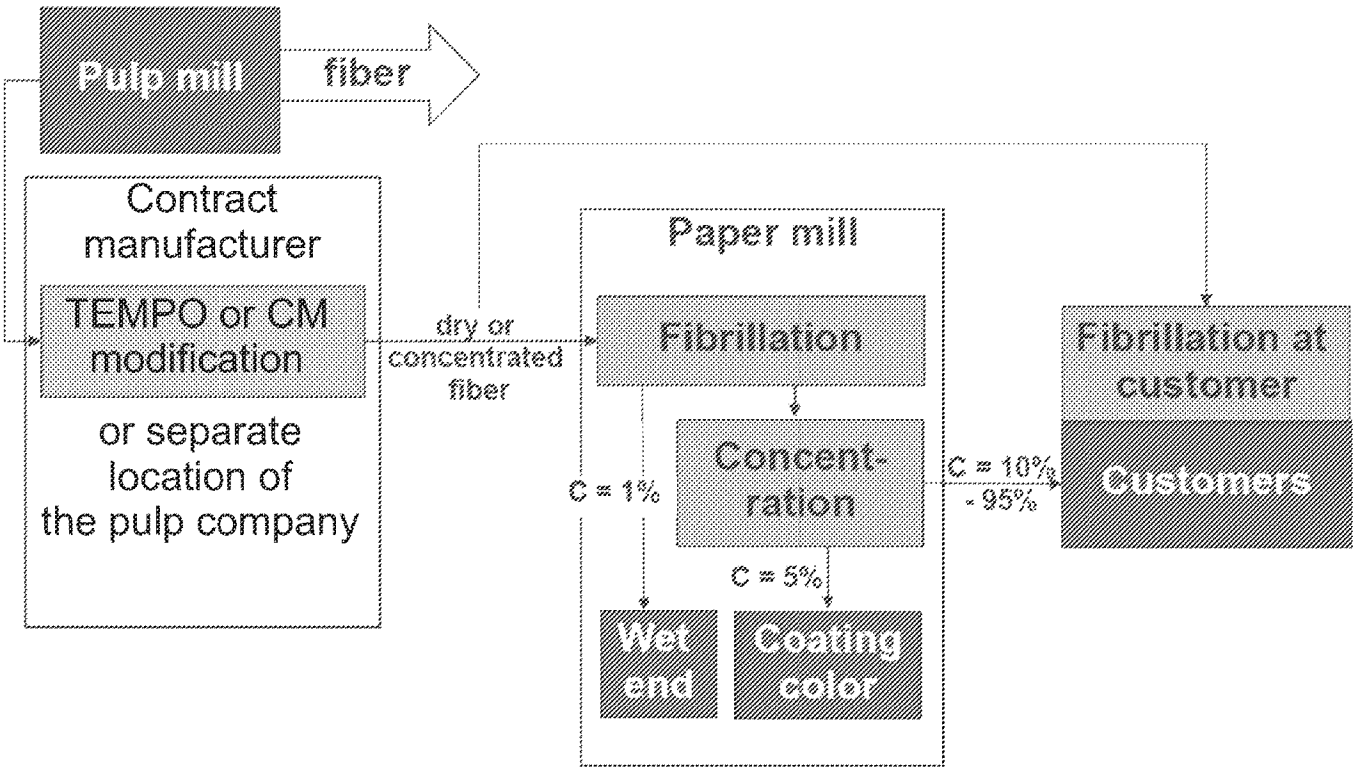
FIG. 2 illustrates the method according to another embodiment.

FIG. 2 differs from FIG. 1 in that the pulp produced by the pulp mill is modified in a separate location which is the manufacturing location for the easily fibrillated pulp. This manufacturing location dispatches the easily fibrillated pulp to the location of use, the paper mill, in a same way as in FIG. 1, but additionally the manufacturing location dispatches the easily fibrillated pulp directly to other customers, which may use the "on-site" fibrillated NFC to other purposes than for paper manufacture.

It is also possible that the manufacturing location is a pulp mill as in FIG. 1, and it dispatches the easily fibrillated pulp directly to customers, which may use the "on-site" fibrillated NFC to other purposes than for paper manufacture.

The dispatch in FIGS. 1 and 2 can take place by road, railway or sea in a suitable vehicle or vessel.

Figure 6:
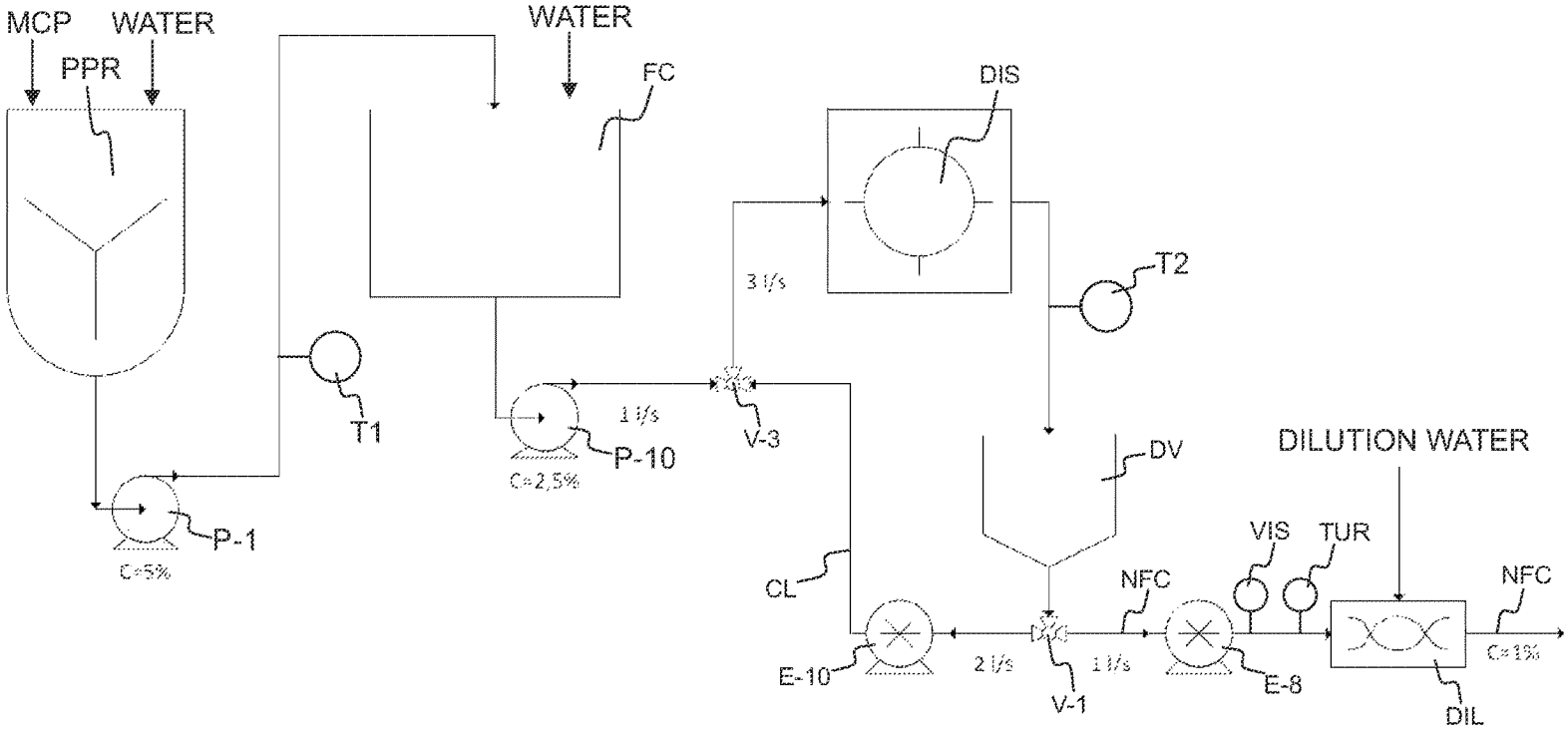
FIGS. 6 and 7 show examples of apparatuses for manufacturing nanofibrillar cellulose at the location of use.
Figure 7:
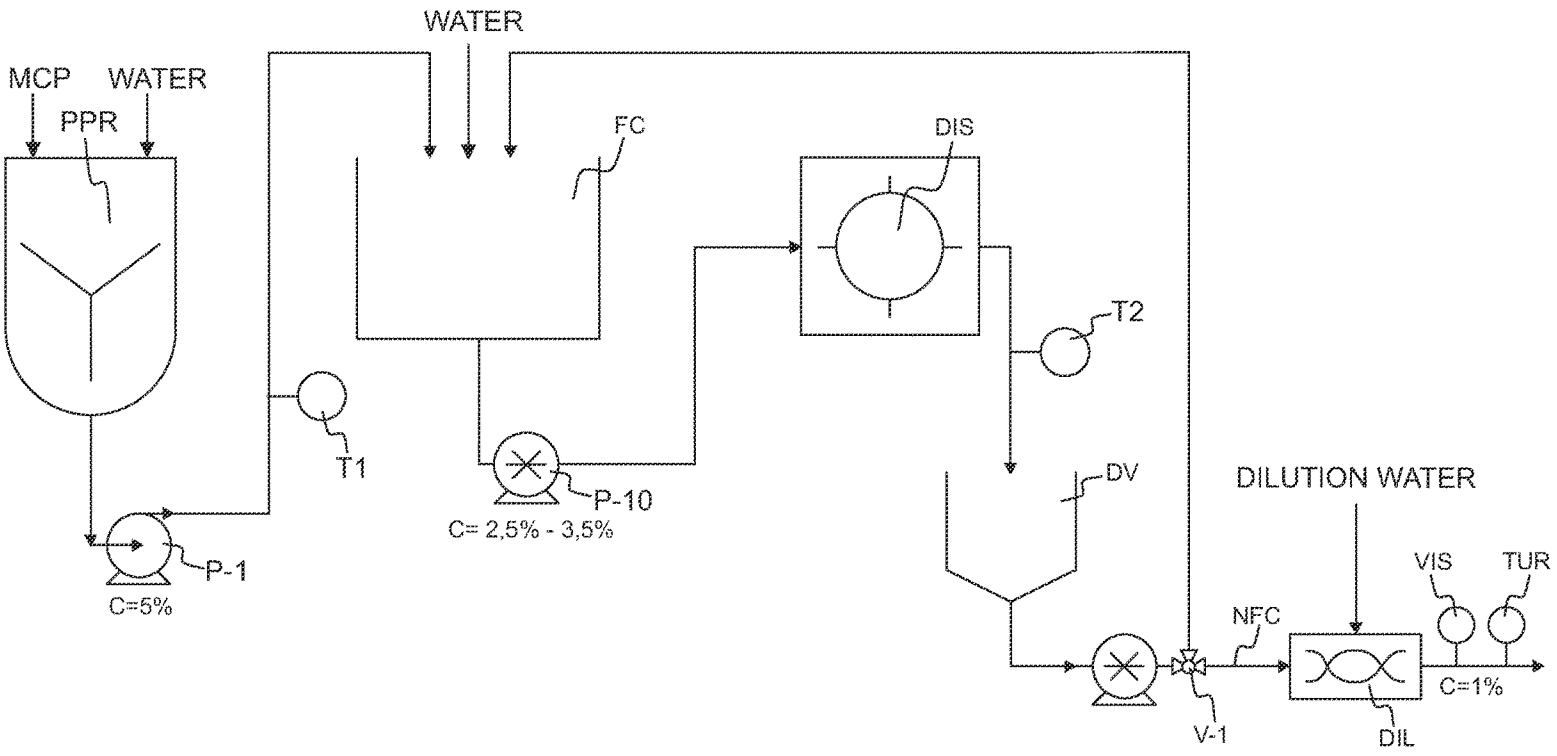

FIGS. 6 and 7 show the setup of the manufacturing apparatus at the location of use for two alternative modes for making the nanofibrillar cellulose, FIG. 6 for the continuous mode and FIG. 7 for the batch mode.

The manufacturing apparatus installed at the location of use comprises a pulper PPR, a disintegrating device DIS, a discharge vessel DV, a conduit connecting the pulper to the disintegrating device, a conduit connecting the disintegrating device to the discharge vessel, and a pump (P-1) for feeding modified cellulose pulp from the pulper PPR to the disintegrating device DIS. These elements are common for the continuous mode and the batch mode.

The apparatus can also have a feeding chest FC, which acts as a intermediate buffer container to ensure continuous feed of the pulp to the disintegrating device DIS in the continuous mode. In this case the apparatus also comprises a conduit connecting the feeding chest to the disintegrating device and a pump (P-10) for feeding modified cellulose pulp from the feeding chest to the disintegrating device. In the pulper PPR, the modified cellulose pulp is pulped and diluted to a consistency of about 6-7 wt-%. The final dilution to the disintegration consistency can take place in the feeding chest FC, to which dilution water is also added, or in any place between the pulper and the disintegrating device.

In the continuous mode, the feeding chest FC can be replaced by another pulper. The pulpers feed alternately the pulp to the disintegrating device DIS to ensure even supply to the disintegrating process.

In the batch mode (FIG. 7), there is also a circulation arrangement for returning the pulp passed through the disintegrating device back to the disintegrating device. The continuous mode (FIG. 6) can also have a circulation arrangement (circulation line CL) which returns a portion of the pulp passed through the disintegrating device DIS back to the disintegrating device. This circulation ratio (returned portion/total flow) can be adjusted. Thus, in both modes the apparatus comprises a circulation conduit connecting the outlet of the discharge vessel DV to the inlet of the disintegrating device DIS (FIG. 6, continuous) or to the feeding chest FC (FIG. 7, batch). In FIG. 7, the valveV-1 after a discharge pump (E-8) is closed to the exit direction and it is open to the circulation direction. When a sufficient number of passes through the disintegrating device has been reached, the circulation direction is closed and the exit direction is opened, and the nanofibrillar cellulose NFC exits the disintegrating process pumped by the discharge pump. In FIG. 6, there is a three-way connection V-1 after the discharge vessel DV, and there is a pump (E-8) in the discharge conduit which leads out of the disintegrating process and a pump (E-10) in the circulation conduit that connects the outlet of the discharge vessel DV to the inlet of the disintegrating vessel DIS. The circulation ratio can be adjusted by adjusting the output of the pumps E-8 and E-10.

In the continuous mode of FIG. 6, the circulation ratio is 10-90%, preferably 30-70%. In the circulation ratio of 67%, ⅔ of the total flow is returned back, which means 3 passes through the disintegrating device DIS. However, the continuous mode also includes the alternative where the pulp suspension is passed once through the disintegrating device DIS, which is possible especially with high-quality modified pulp of low conductivity.

The apparatus both in FIGS. 6 and 7 also comprises a dilution device DIL connected to the outlet of the discharge vessel DV for diluting the nanofibrillar cellulose to the use concentration. This device is not necessarily needed if the nanofibrillar cellulose exits the disintegrating process at the use concentration, or if it is to be diluted later, just before the use.

In the apparatus according to FIG. 6 or FIG. 7 the disintegrating device DIS can be a disperser-type device, where the modified cellulose pulp flows through several counter-rotating rotors in such a way that the material is repeatedly subjected to shear and impact forces by the effect of the different counter-rotating rotors, or it can be a homogenizer, where the modified cellulose pulp is subjected to homogenization by the effect of pressure.

The apparatus can also comprise instrumentation for measuring some variables of the modified cellulose pulp and/or the nanofibrillar cellulose NFC which characterize the efficiency of the fibrillation and the quality of the product. This instrumentation comprises a temperature sensor T1 before the disintegrating device DIS and a temperature sensor T2 after the disintegrating device DIS for measuring the temperature difference T2–T1, which equals the temperature rise during the disintegration and is a measure of the efficiency of the process, and it can be also used for the process control. To measure the properties of the nanofibrillar cellulose itself, the apparatus also comprises an on-line turbidometer TUR which can be calibrated to the modified cellulose pulp grade that is processed and consequently to the nanofibrillar cellulose grade that is produced. The apparatus can also comprise an on-line viscometer VIS based on pressure difference. These measuring instruments are placed in a suitable place after the disintegrating device DIS, preferably to the place where the final product flows. In FIG. 6, these on-line instruments are placed before the dilution device DIL and in FIG. 7, the instruments are placed after the dilution device DIL. Both on-line instruments are not necessarily needed. The customer can choose between an on-line turbidometer TUR an on-line viscometer VIS, according to the properties of the NFC important in the use of the NFC.

Figure 8:
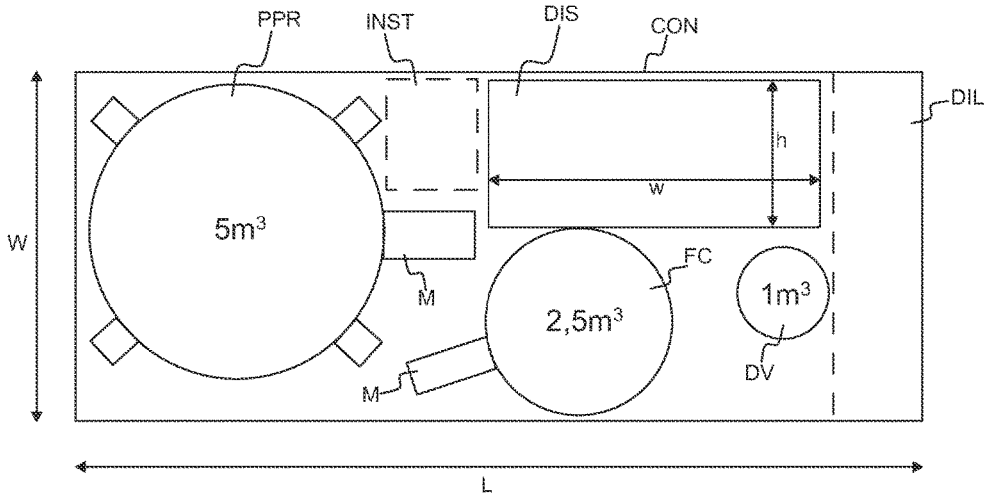
FIG. 8 shows a transportable apparatus for manufacturing nanofibrillar cellulose.

FIG. 8 is an example how the apparatus can be transported to the location of use. It is possible to send the apparatus to the user in the same transport as the modified cellulose pulp or separately. A compact transport container is used. FIG. 8 shows, in horizontal section, a standard DC (dry cargo) shipping container CON (ISO shipping container), with the length L of 20 ft and width W×height of 8 ft, corresponding to the nominal length×width×height of 6 m×2.4 m×2.4 m. Inside the container CON of these dimensions, a pulper PPR, a feeding chest FC, a disintegrating device DIS, and a discharge vessel DV can be packed. The pulper PPR and the feeding chest FC comprise also the mixer motor M. If the apparatus comprises two pulpers and no feeding chest, like in one alternative of the continuous mode apparatus, the pulpers can be smaller. A dilution device DIL can also be packed in the container CON. The container can also include the instrumentation, such as the temperature sensors, on-line turbidometer and on-line viscometer, all packed in an instrument box INST. If the disintegrating device DIS is a disperser-type device that has several counterrotating rotors, its general shape is a cylinder with diameter w and height h, as shown in FIG. 8.

The volumes of the various vessels in the container CON are given only as one practical example.

Thus, the container CON shown in FIG. 8 comprises the elements for installing the apparatus in the setup of FIG. 6 or FIG. 7, or in any other setup.

Customers that use the NFC to other purposes than for papermaking can be construction companies, composite material manufacturers, pharmaceutical companies, cosmetics manufacturers, food companies, oil companies, or coating material manufacturers. The customers and the related uses are not limited to the listed customers, but the modified cellulose pulp can be dispatched anywhere where there is need to use nanofibrillar cellulose.

The invention claimed is:

1. A method for making modified cellulose products, comprising processing cellulose pulp to modified cellulose pulp at a manufacturing location to increase the susceptibility of fibers to disintegration, setting the modified cellulose pulp to a suitable dry matter content, and transporting the modified cellulose pulp at set dry matter content to a location of use, which is a different location from the manufacturing location, where the modified cellulose pulp is disintegrated to nanofibrillar cellulose, wherein the dry matter content of the modified cellulose pulp is set to 20-60%.

2. The method according to claim 1, wherein the processing of cellulose pulp to modified cellulose pulp takes place by chemical or physical or enzymatic modification.

3. The method according to claim 2, wherein the processing of cellulose pulp takes place by chemical modification, where anionized or cationized cellulose is obtained.

4. The method according to claim 3, wherein the chemical modification is catalytic oxidation of cellulose, where carboxyl groups are produced in the cellulose.

5. The method according to claim 3, wherein the chemical modification is carboxymethylation of cellulose or cationization of cellulose.

6. The method according to claim 1, wherein the manufacturing location is a pulp mill.

7. The method according to claim 1, wherein the modified cellulose pulp is washed before transporting the modified cellulose pulp.

8. The method according to claim 7, wherein the modified cellulose pulp is washed by diluting it with washing water, and the setting of the dry matter content comprises concentrating the modified cellulose pulp by mechanically removing the washing water.

9. The method according to claim 7, wherein the setting of the dry matter content comprises increasing the dry matter content further by evaporation after washing.

10. The method according to claim 1, wherein the modified cellulose is washed, and the measured conductivity of the modified cellulose pulp after washing, when suspended at a consistency of 2.5 wt-% in deionized water, is below 200 mS/m.

11. The method according to claim 1, wherein the modified cellulose pulp is transported in rigid containers or in bags, especially in big bags (FIBC-type bags).

12. The method according to claim 1, wherein it comprises:

diluting the modified cellulose pulp at the location of use from the increased dry matter content to a disintegrating consistency, and disintegrating the modified cellulose pulp at the disintegrating consistency to nanofibrillar cellulose.

13. The method according to claim 12, wherein it comprises:

mixing the modified cellulose pulp with water in a pulper, feeding the modified cellulose pulp from the pulper to a disintegrating device, treating the modified cellulose pulp in the disintegrating device which disintegrates the modified cellulose pulp to nanofibrillar cellulose, and collecting the nanofibrillar cellulose issuing from the disintegrating device.

14. The method according to claim 13, wherein the nanofibrillar cellulose is produced in a continuous mode.

15. The method according to claim 14, wherein during the continuous mode part of the output of the disintegrating device is circulated to the feed of the disintegrating device.

16. The method according to claim 13, wherein the nanofibrillar cellulose is produced in a batch mode.

17. The method according to claim 1, wherein the modified cellulose is washed, and the measured conductivity of the modified cellulose pulp after washing, when suspended at a consistency of 2.5 wt-% in deionized water, is below 150 mS/m.

18. The method according to claim 1, wherein the modified cellulose is washed, and the measured conductivity of the modified cellulose pulp after washing, when suspended at a consistency of 2.5 wt-% in deionized water, is below 100 mS/m.

19. The method according to claim 1, wherein transporting the modified cellulose pulp is by road vehicle, train, ship, air freight, or a combination thereof.

* * * * *